US005760703A

United States Patent [19]

Becker

[11] Patent Number: 5,760,703

[45] Date of Patent: Jun. 2, 1998

[54] REMOTE CONTROLLED SECURITY SWITCH

[75] Inventor: Alan Becker, Edon, Ohio

[73] Assignee: Brammall, Inc., Angola, Ind.

[21] Appl. No.: 542,060

[22] Filed: Oct. 12, 1995

[51] Int. Cl.[6] ..... H01Q 7/00

[52] U.S. Cl. ..... 340/825.69; 340/825.72; 340/825.31; 340/825.34; 235/380; 235/382; 235/382.5; 70/276; 70/277; 70/278

[58] Field of Search ..... 340/825.69, 825.72, 340/825.31, 825.34; 70/276, 277, 278; 235/380, 382, 382.5

[56] References Cited

U.S. PATENT DOCUMENTS 4,688,244 8/1987 Hannon et al. ..... 379/58

4,866,963 9/1989 Leininger et al. ..... 70/278

*Primary Examiner*—Michael Horabik
*Assistant Examiner*—Yonel Beaulieu
*Attorney, Agent, or Firm*—Hill & Simpson

[57] ABSTRACT

The remote controlled security device which can be controlled by a radiant energy transmitter so as to lock or unlock it, is mounted on the inside wall of a container and has a locking bar which is engageable with a locking plate that has an aligned opening for receiving locking bar of the security device. The locking bar can be moved by stepper motor from the locked to the unlocked position in response to actuation of the remote control transmitter to allow the door of the container to be locked or unlocked. There is also provided a key with an opening which can be inserted through the wall of the container to engage a projection which has the same shape as the opening in the key to allow the lock to be manually locked or unlocked.

5 Claims, 3 Drawing Sheets

REMOTE CONTROLLED SECURITY SWITCH

BACKGROUND OF THE INVENTION

1. Field of the Invention

This invention relates generally to security devices and in particular to a novel remote control security device for trucks and railroad cars and other containers.

2. Description of the Related Art

Remote control radio devices are known such as radio controls for garage door openers, radio control for drone or model airplanes. At times, it is desirable to provide a security device on containers, such as truck bodies, railroad box cars and other containers, which will prevent them from being opened except by authorized personnel.

SUMMARY OF THE INVENTION

The present invention provides a remote control security device for a container, such as a truck body or a railroad car, which can be controlled by a radio or infrared or other radiation type transmitter so as to remotely lock or unlock the security device. It is a feature of the present invention to provide a stepping motor which is connected to a locking latch so as to move it in either of two directions so as to move the locking latch to a locked position or to an unlocked position.

It is another object of the present invention to provide a remote control security device, which can be activated to lock or unlock it by a remote radiation transmitter.

It is yet another feature of the invention to provide a manual unlocking and locking mechanism for a security device which is normally controlled by a remote transmitter which includes a key that can be inserted into the security device so as to manually move the locking latch between the locked and unlocked positions.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

Figure 1:
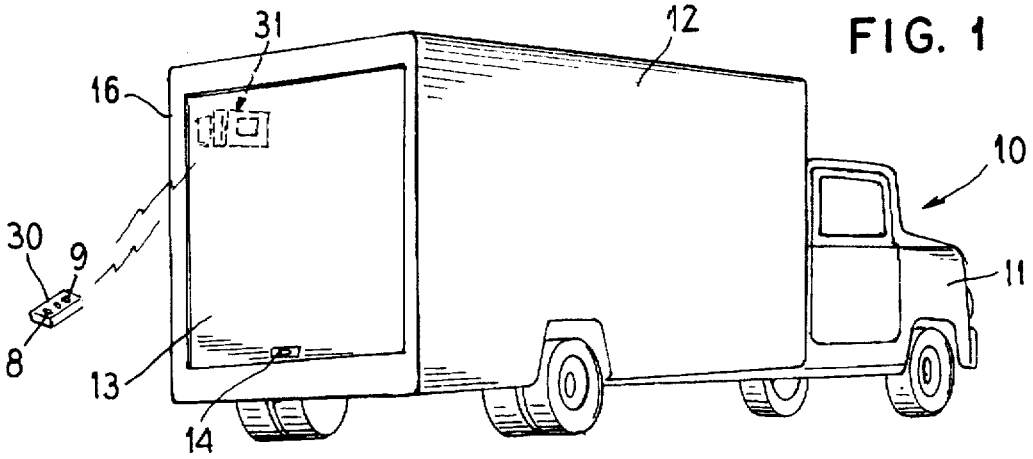
FIG. 1 is a perspective view of a truck illustrating the remote controlled security device of the invention.

FIG. 1 illustrates a truck 10 which has a cab 11 and a cargo body 12. A door 13 is attached to the body 12 and, in a particular example, may be moveable in a vertical direction. The door 13 is locked with a conventional mechanical lock 14 which has a handle so that the door 13 may be manually opened or closed when the lock 14 is unlocked.

Attached to the inside of one of the walls 16 of the body 12 is a remote security device 31 of the invention, which comprises a secondary locking mechanism for the door 13 so that even when the conventional lock 14 is unlocked, the door 13 will still remain secured in the closed position until the remote control security lock 31 is actuated by a remote radiation transmitter 30. The transmitter 30 has an unlock switch 8 and a lock switch 9. When the lock switch 8 of the transmitter 30 is actuated, a radio signal is sent to a receiver 101 in the security device 31 so as to cause it to lock the door 13 so that it cannot be opened. When the unlock switch 9 is depressed, the transmitter 30 sends a radio signal to the receiver 101 in the security device 31 so as to unlock the security device. The lock and unlock transmitted signals have different coding, phase or frequency.

Figure 2:
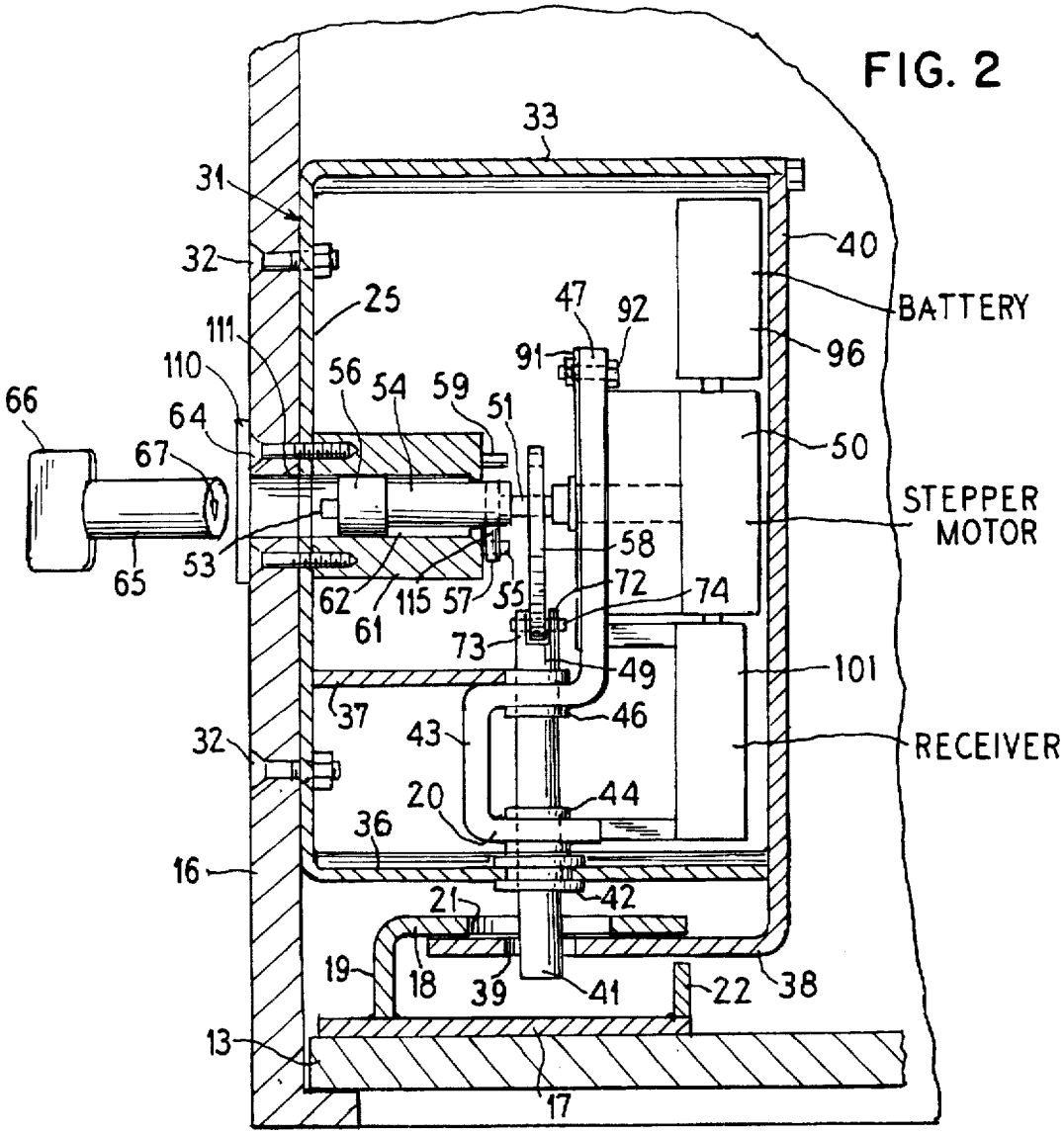
FIG. 2 is a sectional view through the remote control security device of the invention.
Figure 3:
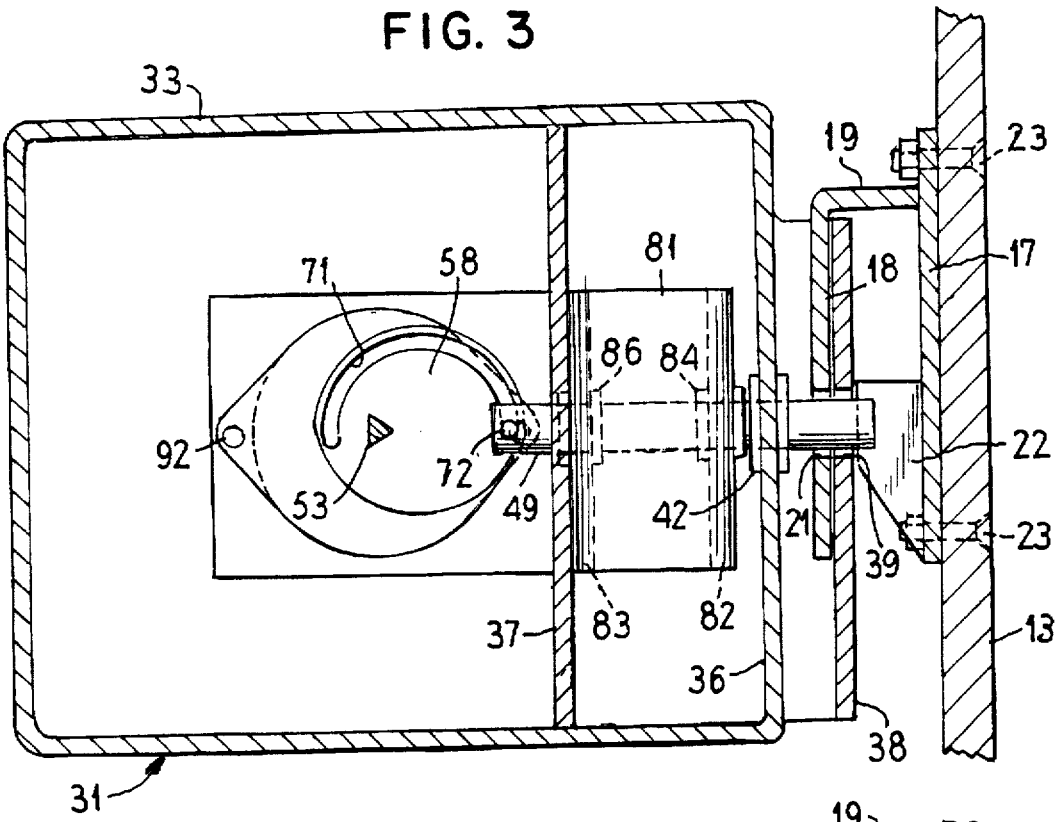
FIG. 3 is a sectional view of the security device illustrating the locked position.
Figure 4:
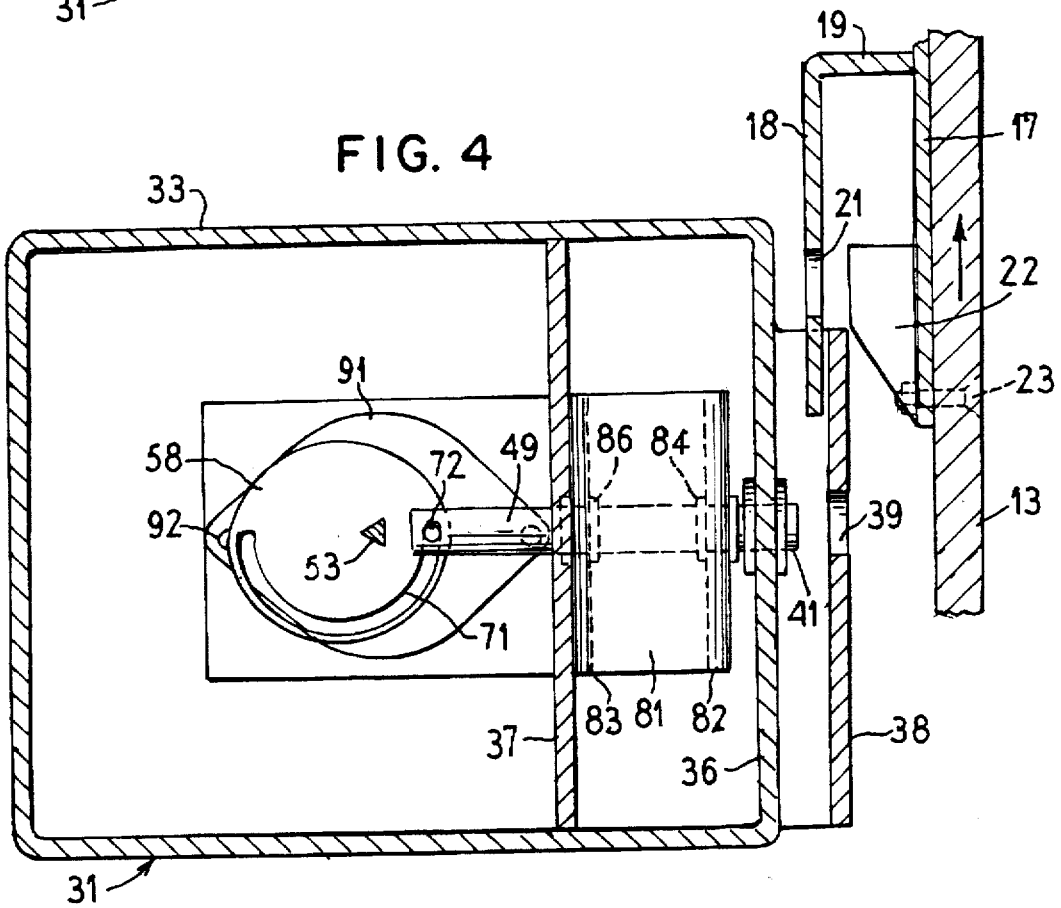
FIG. 4 is a sectional view illustrating the unlocked position of the security device.

FIGS. 2, 3 and 4 illustrate in detail the security device 31, which is attached to the interior of the wall 16 of the truck body 12 by screws and bolts 32 which extend through the wall 16 and are attached to a wall 25 of the security device 31. Transverse walls 33 and 36 extend from opposite ends of the wall 25 and connect to an opposite wall 40 of the security device 31. A stepper motor 50 is connected to a frame member 47 which is connected to the walls of the security device 31, and the output shaft 51 of the stepper motor 50 extends through an opening in the frame member 47 and through a support plate 91. Bolts 92 attach the stepper motor 50 to the frame member 47 as shown in FIGS. 2, 3 and 4. Attached to the output shaft 51 of the stepper motor 50 is a cam plate 58 which is formed with a slot 71 as shown in FIGS. 3 and 4. A locking bolt 41 has one end 49 formed with extensions 73 and 74 which have aligned openings through which the pin 72 extends. The pin 72 also extends through the slot 71 so that, when the cam plate 91 is rotated, the locking bar 41 will be moved to the left or right relative to FIGS. 3 and 4 due to the shape of the slot 71.

The bolt 41 extends through openings formed in frame member 37 and through openings formed in a U-shape portion 43 of the frame member 47. A bearing 46 is mounted in the opening formed in the frame member 37. The U-shape portion 43 of the frame member 47 has a portion 20 which is also formed with an opening through which the locking bar 41 extends. This opening includes a bearing 44. Frame member 36 is also formed with an opening through which the locking bar 41 extends and which includes a guide bearing 42.

An extension 38 is attached to a wall 40 and has an opening 39 through which the locking bar 41 extends when in the locked position as shown in FIGS. 2 and 3. Attached to the inside of the door 13 by bolts and nuts 23 is a locking bracket 17 which has an extending portion 19 which has a locking plate 18 that is formed with an opening 21 through which the locking bar 41 extends when in the locked position as shown in FIGS. 2 and 3. A tapered guide member 22 is connected to the locking plate 17 and assures alignment of the plate 38 with the plate 18.

A manual override is provided so that the security lock 31 can be locked or unlocked from the outside of the body 12 in the event that a transmitter 30 is not available or in the event of malfunctioning of the security device 31 or of the transmitter 30. Such a manual unlocking device comprises a key 65 which has a handle 66 and a unique key opening 67 in one end thereof. A cover plate 110 is connected to the outer wall 16 of the body 12 by screws or other means and can be removed so that the key 65 can be inserted through an opening 111 in the wall 16. A locking member 54 of generally cylindrical shape is received in an opening 62 formed in a cylindrical member 61 that is attached to the wall 25 of the security device 31. A guide collar 56 is attached to the cylindrical member 54 and has a projection 53 that has the same shape as the opening 67 so that the key 67 can fit over the projection 53 to allow the key 65 to turn the member 54. The other end of the member 54 is attached to the drive shaft 51 so that the drive shaft 51 and the cam member 58 can be manually turned by the key 65 so as to lock and unlock the locking bar 41. A rod 115 extends from the end of the member 54 and is engageable with pins 55 and 59 which are attached to a member 61 so as to limit the rotation of the member 54 by the key 65 so that it moves the locking bar 41 only from the locked to the unlocked position or from the unlocked to the locking position.

Figure 5:
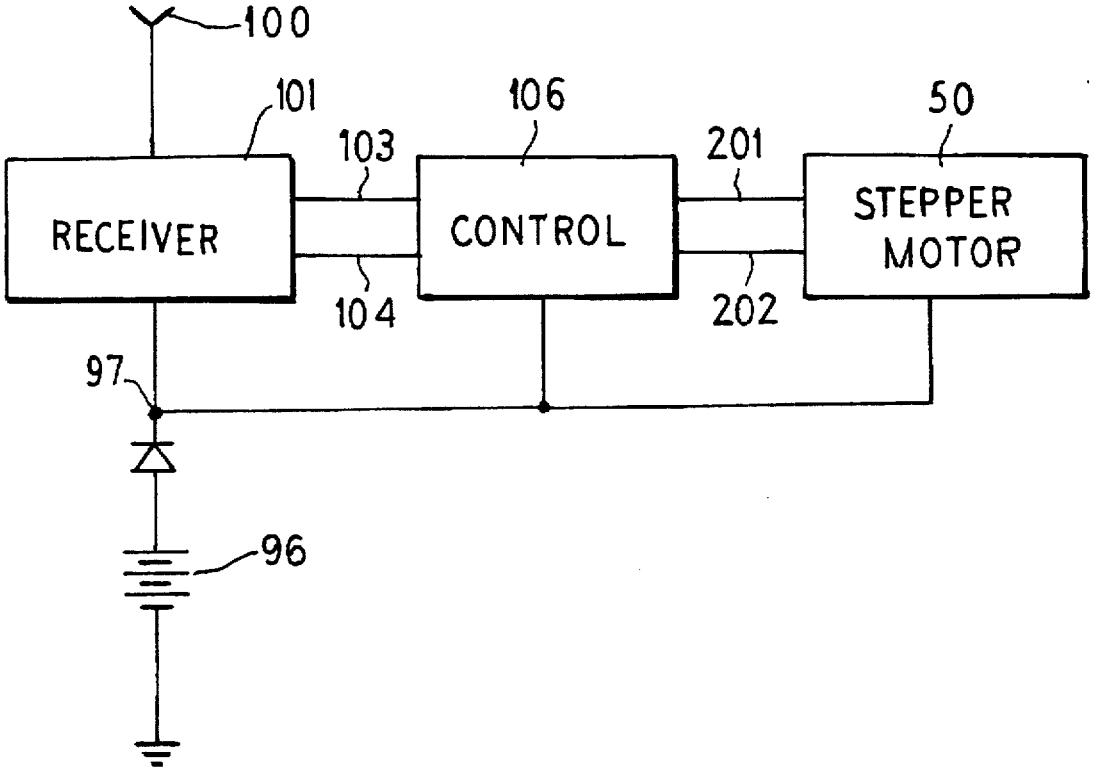
FIG. 5 is an electrical schematic view illustrating the remote control security device of the invention.

FIG. 5 illustrates the electrical schematic of the invention. A battery 96 has one terminal connected to ground, and another terminal is connected through a diode D1 to a power terminal 97. The receiver 101 receives power from the terminal 97 and is provided with an antenna 100 to receive radio energy from the transmitter 30. The receiver 101 provides on a lead 103 an "open" command and provides on a lead 104 a "close" command depending whether the open or close switches 8 and 9 of the transmitter 30 have been energized. A control 106 is connected to the leads 103 and 104 and provides stepper motor control outputs on leads 201 and 202 to the stepper motor 50 to cause the stepper motor to rotate in either one or the other direction to lock or unlock the security device 31. The control 106 receives power from the power terminal 97.

In operation, if the lock switch 9 of the transmitter 30 is energized, the receiver 101 will receive a signal and will provide an output on lead 104 to command the stepper motor 50 to rotate until the locking bar 41 is in the locked position shown in FIGS. 2 and 3. The stepping motor 50 may step its output shaft 10° per step and will be energized until the locking bar 41 is in the full extended locked position shown in FIGS. 2 and 3 because the pin 72 moves in the slot 71 which moves the bar 41 to the locked position. The stepping motor 50 will stop after reaching the fully locked position. When the unlock switch 8 of the transmitter 30 is energized, the receiver 101 will produce an electrical output on lead 103 which will cause the control 106 to energize the stepper motor 50 which causes the stepper motor 50 to rotate in the reverse direction so that the stepper motor 50 will move the locking bar 41 to the position shown in FIG. 4 wherein the locking bar 41 is withdrawn to the unlocked position, thus allowing the door 13 to be opened.

In the event it is desired to lock or unlock the door under conditions where the authorized personnel does not have the transmitter 30 or under conditions wherein either the transmitter 30 or the security device is inoperative, the authorized personnel can remove the plate 110 from the external wall 16 of the body 12 and insert the key 65 into the opening 111 so that the projection 53 is received in the unique opening 67, and the key 65 can be rotated to move the drive shaft 51 from the locked to the unlocked position between stop limits 55 and 59.

It is seen that this invention provides a novel remote control security device, and although the invention has been described with respect to preferred embodiments, it is not to be so limited as changes and modifications can be made therein which are within the full intended scope of the invention as defined by the appended claims.

I claim as our invention:

1. A remotely controlled security device comprising:

a container with a movable door, said security device connected to said container and provided with a movable locking bar which is engageable with said door to selectively lock or unlock the doors;

a radiant energy transmitter with lock and unlock switches;

a radiant energy receiver connected to said security device to receive signals from said energy transmitter;

a stepper motor mounted in said security device and connected to receive output signals from said receiver;

an output shaft of said stepper motor connected to said locking bar to move the output shaft between the locked and unlocked position;

a unique extension formed on said output shaft; and a key with a mating unique opening which can receive said unique extension to allow said output shaft to rotate between the locked and unlocked positions.

2. The remote controlled security device according to claim 1 wherein said security device is attached to an inner wall of said container, and an opening formed through said inner wall through which said key can be extended to engage said output shaft.

3. The remote controlled security device according to claim 2 further comprising:

a removable cover plate attached over said opening.

4. A security device for a container with a movable door, the device comprising:

a stepper motor with an output shaft connected to said container;

a cam plate mounted on said output shaft and formed with an arcuate slot;

a locking bar mounted for longitudinal movement coupled to said arcuate slot in said cam plate, said locking bar engageable with said door and longitudinally movable between locked and unlocked positions;

a radiant energy receiver connected to said stepping motor to actuate it to the locked and unlocked positions; and a radiant energy transmitter with lock and unlock switches for energizing said radiant energy receiver.

5. The security device according to claim 4 further comprising:

a key with a unique opening wherein said output shaft is formed with a unique projection which is receivable within said unique opening so that said key can rotate said output shaft.

* * * * *